US006352810B1

(12) United States Patent
Jiang et al.

(10) Patent No.: US 6,352,810 B1
(45) Date of Patent: Mar. 5, 2002

(54) TONER COAGULANT PROCESSES

(75) Inventors: Lu Jiang, Oakville; Walter Mychajlowskij, Mississauga; Michael A. Hopper, Toronto, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/784,417

(22) Filed: Feb. 16, 2001

(51) Int. Cl.[7] ..... G03G 9/087

(52) U.S. Cl. ..... 430/137.11; 430/137.14; 430/137.16

(58) Field of Search ..... 430/137.11, 137.14, 430/137.16

(56) References Cited

U.S. PATENT DOCUMENTS

| | | | | |
|---|---|---|---|---|
| 3,674,736 A | | 7/1972 | Lerman et al. | 260/41 R |
| 4,137,188 A | | 1/1979 | Uetake et al. | 252/62.1 P |
| 4,558,108 A | | 12/1985 | Alexandru et al. | 526/340 |
| 4,797,339 A | | 1/1989 | Maruyama et al. | 430/109 |
| 4,983,488 A | | 1/1991 | Tan et al. | 430/137 |
| 4,996,127 A | | 2/1991 | Hasegawa et al. | 430/109 |
| 5,066,560 A | | 11/1991 | Tan et al. | 430/137 |
| 5,213,938 A | * | 5/1993 | Sacripante et al. | 430/137.11 |
| 5,278,020 A | | 1/1994 | Grushkin et al. | 430/137 |
| 5,290,654 A | | 3/1994 | Sacripante et al. | 430/137 |
| 5,308,734 A | | 5/1994 | Sacripante et al. | 430/137 |
| 5,344,738 A | | 9/1994 | Kmiecik-Lawrynowicz et al. | 430/137 |
| 5,346,797 A | | 9/1994 | Kmiecik-Lawrynowicz et al. | 430/137 |
| 5,348,832 A | | 9/1994 | Sacripante et al. | 430/109 |
| 5,364,729 A | | 11/1994 | Kmiecik-Lawrynowicz et al. | 430/137 |
| 5,366,841 A | | 11/1994 | Patel et al. | 430/137 |
| 5,370,963 A | | 12/1994 | Patel et al. | 430/137 |
| 5,403,693 A | | 4/1995 | Patel et al. | 430/137 |
| 5,405,728 A | | 4/1995 | Hopper et al. | 430/137 |
| 5,418,108 A | | 5/1995 | Kmiecik-Lawrynowicz et al. | 430/137 |
| 5,496,676 A | | 3/1996 | Croucher et al. | 430/137 |
| 5,501,935 A | | 3/1996 | Patel et al. | 430/137 |
| 5,527,658 A | | 6/1996 | Hopper et al. | 430/137 |
| 5,585,215 A | | 12/1996 | Ong et al. | 430/107 |
| 5,650,255 A | | 7/1997 | Ng et al. | 430/137 |
| 5,650,256 A | | 7/1997 | Veregin et al. | 430/137 |
| 5,723,253 A | | 3/1998 | Higashino et al. | 430/166 |
| 5,744,520 A | | 4/1998 | Kmiecik-Lawrynowicz et al. | 523/334 |
| 5,747,215 A | | 5/1998 | Ong et al. | 430/137 |
| 5,763,133 A | | 6/1998 | Ong et al. | 430/137 |
| 5,766,818 A | | 6/1998 | Smith et al. | 430/137 |
| 5,804,349 A | | 9/1998 | Ong et al. | 430/110 |
| 5,827,633 A | | 10/1998 | Ong et al. | 430/137 |
| 5,840,462 A | | 11/1998 | Foucher et al. | 430/137 |
| 5,853,944 A | | 12/1998 | Foucher et al. | 430/137 |
| 5,863,698 A | | 1/1999 | Patel et al. | 430/137 |
| 5,869,215 A | | 2/1999 | Ong et al. | 430/137 |
| 5,902,710 A | | 5/1999 | Ong et al. | 430/110 |
| 5,910,387 A | | 6/1999 | Mychajlowskij et al. | 430/110 |
| 5,916,725 A | | 6/1999 | Patel et al. | 430/137 |
| 5,919,595 A | | 7/1999 | Mychajlowskij et al. | 430/137 |
| 5,925,488 A | | 7/1999 | Patel et al. | 430/137 |
| 5,977,210 A | | 11/1999 | Patel et al. | 523/161 |
| 5,994,020 A | | 11/1999 | Patel et al. | 430/137 |
| 6,132,924 A | | 10/2000 | Patel et al. | 430/137 |

* cited by examiner

*Primary Examiner*—John Goodrow
(74) *Attorney, Agent, or Firm*—E. O. Palazzo

(57) ABSTRACT

A process for the preparation of toner comprising mixing a colorant, a latex, and a polyamine followed by aggregation and coalescence, and wherein said process is accomplished in the presence of an oxidizing agent.

35 Claims, No Drawings

TONER COAGULANT PROCESSES

PENDING APPLICATIONS AND PATENTS

In U.S. Pat. No. 6,132,924, the disclosure of which is totally incorporated herein by reference, there is illustrated a process for the preparation of toner comprising mixing a colorant, a latex, and two coagulants, followed by aggregation and coalescence, and wherein one of the coagulants may be polyaluminum chloride.

In U.S. Pat. No. 6,268,102, filed Apr. 17, 2000, on "Toner Coagulant Processes", the disclosure of which is totally incorporated herein by reference, there is illustrated a process for the preparation of toner comprising mixing a colorant, a latex, and two coagulants, followed by aggregation and coalescence, and wherein one of the coagulants is a polyaluminum sulfosilicate.

In copending application U.S. Ser. No. 922,437, filed Sep. 2, 1997, on "Metal-Accelerated Toner Processes", the disclosure of which is totally incorporated herein by reference, is illustrated, for example, a process for the preparation of toner comprising (i) aggregating with a metal complex, or metal ion a colorant dispersion with a latex emulsion and optional additives to form aggregates;

(ii) coalescing or fusing the aggregates; and optionally (iii) isolating, washing, and drying the toner.

Illustrated in U.S. Pat. No. 5,994,020, the disclosure of which is totally incorporated herein by reference, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

The appropriate components and processes of the above recited copending applications and patents may be selected for the processes of the present invention in embodiments thereof.

BACKGROUND

The present invention is directed to a toner process, and more specifically, to chemical toner processes which involve the aggregation and fusion of latex, colorant like pigment, or dye, and additive particles into toner particles, and wherein aggregation can be primarily controlled by utilizing a coagulant of polyamine salts formed, for example, by reacting a diethyleneamine (DETA) or a dialkylene amine with an acid, and which salts are commercially available, and wherein there is preferably selected a latex comprised of, for example, submicron resin particles in the size range of, for example, about 0.1 to about 0.4 micron in volume average diameter, suspended in an aqueous phase of water, nonionic and anionic surfactants and optionally suspended in an anionic surfactant to which is added a colorant dispersion comprising, for example, submicron colorant particles in the size range of, for example, about 0.08 to about 0.3 micron in volume average diameter, anionic surfactant, or optionally a nonionic surfactant, or mixtures thereof, and optionally adding a wax dispersion comprising submicron wax particles in the size range of, for example, about 0.1 to about 0.3 micron in volume average diameter, suspended in an aqueous phase of water and an anionic surfactant, and wherein the resultant blend can be stirred and heated to a temperature below the latex resin Tg, resulting in toner aggregates to which is optionally added a second latex, followed by adjusting the pH of the mixture with a base and adding an organic or an inorganic oxidative reagent thereby preventing the formation of further cations or salts and heating the resulting mixture to a temperature above the latex resin Tg, followed by lowering the pH of the mixture with an acid to fuse the aggregates.

More specifically, the present invention is directed to the aggregation of latex, colorant like pigment, dye, or mixtures thereof, and optionally a wax in the presence of a polyamine salt, and wherein an organic or an inorganic oxidative reagent is introduced upon the completion of aggregation or heating below the latex resin Tg, and prior to coalescence or heating above the latex resin Tg wherein oxidative reagent prevents the formation of multivalent cations, such as NH3+, CH2+, and the like, and which can be introduced when the pH is lowered during coalescence, and wherein the generation of the further cations can function as a coagulant thereby initiating undesirable further growth in toner particle size. With the processes of the present invention there can be generated dry toners, for example, of a volume average diameter of from about 1 micron to about 25 microns, and more specifically, from about 2 microns to about 12 microns, and a narrow particle size distribution (GSD) of, for example, from about 1.10 to about 1.33, and more specifically, a size distribution in the range of 1.11 to 1.25, the size and size distribution being measured by a Coulter Counter, without the need to resort to conventional pulverization and classification methods. Furthermore, the present invention in embodiments enables minimum washing, for example about 2 to about 4 washings to provide a suitable toner triboelectrical charge such as greater than about 20 $\mu$C/g at about 50 percent RH. In embodiments of the present invention, organic or inorganic reagents oxidatively remove the polyamine salts initially used as a coagulating or flocculating agent after aggregation and prior to coalescence.

The present invention is, more specifically, directed to the utilization of an organic coagulating component with, for example, a resin emulsion like a styrene acrylate where the emulsion possesses, for example, a pH of about 2 to about 5, and removal of the coagulant following the aggregation of the latex, colorant and optionally wax particles by oxidative means, such as the use of sodium periodate, bleach, and the like thereby rendering the aggregate particles stable at low pH conditions. The use of oxidative reagents during the fabrication of toner particles provides, for example, wide process latitudes wherein the pH can be easily lowered to about 2.5 thereby accelerating the coalescence rate by about 1.5 times without further increases in toner particle size when compared to the use of polyaluminum chloride as a coagulant.

The toners generated with the processes of the present invention can be selected for copy and printing processes, including color processes and for imaging processes, especially xerographic processes, which usually prefer a toner transfer efficiency in excess of greater than about 90 percent, such as those with a compact machine design without a cleaner or those that are designed to provide high quality colored images with excellent image resolution, acceptable signal-to-noise ratio, and image uniformity. Also, the toners obtained with the processes illustrated herein can be selected for digital imaging systems and processes.

PRIOR ART

In xerographic systems, especially color systems, small sized toners of, for example, from about 2 to about 8 microns can be important to the achievement of high image quality for process color applications. It is also important to have a low image pile height to eliminate, or minimize image feel and avoid paper curling after fusing. Paper curling can be particularly pronounced in xerographic color processes primarily because of the presence of relatively high toner coverage as a result of the application of three to four color toners. During fusing, moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it can be desirable to select certain toner particle sizes, such as from about 2 to about 10 microns, with a high colorant, especially pigment loading, such as from about 4 to about 15 percent by weight of toner, so that the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions such as temperature and humidity. Toners prepared in accordance with the processes of the present invention minimize, or avoid these disadvantages.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. This process results, it is believed, in the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization. Other prior art includes U.S. Pat. Nos. 3,674,736; 4,137,188 and 5,066,560.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. The appropriate components and processes of the above Xerox Corporation patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersions, thus enabling the achievement of excellent color print quality and providing similar charging behavior despite differential colorant chemistry.

Another feature of the present invention resides in a process of preparing pigmented styrene acrylate toner particles with cationic coagulants, such as diethylenetriamine (DETA), which when reacted with an acid such as hydrochloric acid result in a salt of the amine and generally the reaction forms a polyamine salt of the acid and wherein the polyamine salt is used as coagulant to form toner size aggregate particles comprised of latex resin, colorant and optionally wax particles, and wherein the polyamine salt is readily oxidized by an oxidizing reagent such as commercial bleach thereby avoiding the formation of multivalent cations.

Additionally, another feature of the present invention resides in a process capable of delivering differing toner morphology particles such as spherically shaped toner particle.

A further feature of the present invention resides in the use of an organic aliphatic or an aromatic amine which when reacted with an acid forms a polyamine salt and wherein the polyamine salt is oxidized with either an inorganic or an organic oxidant during coalescence thereby preventing the formation of multivalent cationic species when the pH is lowered from, for example, 7.5 to about 3.5 and preferably below about pH 2.5 with an acid to increase the coalescence rate.

Aspects of the present invention relate to a process for the preparation of toner comprising (i) providing or generating a latex emulsion of resin, water, and an ionic surfactant, and providing or generating a colorant dispersion containing a colorant, water, an ionic surfactant, or a nonionic surfactant, and wherein (ii) the latex emulsion is blended with the colorant dispersion;

(iii) adding to the resulting blend containing the latex and colorant a suitable coagulant;

(iv) heating the resulting mixture below about the glass transition temperature (Tg) of the latex resin;

(v) optionally adding a second latex comprised of resin particles suspended in an aqueous phase;

(vi) adding an oxidative or oxidizing agent or component to (v) followed by changing the pH with a base from an initial pH of about 1.9 to about 3 to a pH of about 5 to about 9;

(vii) heating (vi) above about the Tg of the latex resin;

(viii) optionally retaining the mixture (vii) at a temperature of from about 70° C. to about 95° C.;

(ix) changing the pH of the mixture (viii) by the addition of an acid to arrive at a pH in the range of about 1.5 to about 3.5;

(x) optionally washing the resulting toner slurry; and (xi) optionally isolating the toner; a process wherein the coagulant is a polyamine salt selected in an amount of, for example, from about 0.05 to about 5 percent by weight of toner; a process wherein the oxidative reagent is selected from the group consisting of an inorganic component of sodium hypochlorite, sodium periodate, ammonium persulfate, and potassium persulfate; a process wherein the polyamine salt coagulant is subjected to an oxidative reaction resulting in neutralization and the formation of cationic ions upon reducing the pH to a value of from about 1.5 to about 3; a process wherein the oxidative agent functions as a toner aggregate stabilizer and allows the pH reduction 3.3 of (ix) to accelerate the fusion of toner aggregates formed in (vi); a process wherein the oxidative agent prevents or minimizes the formation of positive ions of aluminum ($Al^{3+}$) during (ix), and wherein no further or minimal toner particle size growth results; a process wherein the base selected is a metal hydroxide selected from the group consisting of sodium hydroxide, potassium hydroxide, and ammonium hydroxide; a process wherein the oxidative or oxidizing agent is selected in an amount of about 0.1 to about 5 percent by weight of toner comprised of resin and colorant; a process wherein there is added during or subsequent to (iv) a second latex, and which latex is comprised of submicron resin particles suspended in an aqueous phase containing an ionic surfactant, and wherein the second latex is optionally selected in an amount of about 10 to about 40 percent by weight of the initial latex, and wherein there is formed a shell on the product of (iv); a process wherein the second latex (v) is added and enables formation of a shell on the resulting toner aggregates of (iv), and wherein the thickness of the formed shell is from about 0.1 to about 1 micron; a process wherein the added latex contains the same resin as the initial latex of (i), or wherein the added latex contains a dissimilar resin than that of the initial latex resin (i); a process wherein (iv) is accomplished by heating at a temperature below about the glass transition temperature of the resin or polymer contained in the latex (i) and (vii) is accomplished by heating at a temperature of above about the glass transition temperature of the polymer contained in the latex (i) to enable fusion or coalescence of colorant and latex resin (i); a process wherein the temperature (iv) is from about 40° C. to about 60° C., and the temperature (vii) is from about 75° C. to about 97° C.; a process wherein the pH of the mixture resulting in (vi) is increased from an initial about 2 to about 2.6 to about 5 to about 8, and wherein the base selected functions primarily as a stabilizer for the product of (iv); a process wherein subsequent to (iv) toner aggregates are formed, and wherein the temperature at which the aggregation is accomplished controls the size of the aggregates, and wherein the toner isolated is from about 2 to about 15 microns in volume average diameter, and wherein the heating (viii) is accomplished; a process wherein the colorant is a pigment, and wherein the pigment is in the form of dispersion, and which dispersion contains an ionic surfactant; a process wherein the latex (i) contains a resin selected from the group consisting of poly (styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly (propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly (styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); a process wherein the colorant is carbon black, cyan, yellow, magenta, or mixtures thereof, and the toner isolated is from about 1 to about 20 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner; a process wherein the polyamine salt coagulant is an aliphatic polyamine acid; a process wherein the acid is hydrochloric acid, sulfuric acid, nitric acid or phosphoric acid; a process wherein the polyamine is an aromatic polyamine acid salt; a process for the preparation of toner comprising mixing a colorant, a latex, and a sutiable component, such as a polyamine followed by aggregation and coalescence, and wherein the process is accomplished in the presence of an oxidizing agent; a process wherein the colorant is a colorant dispersion comprised of (i) a colorant, water, an ionic surfactant, a nonionic surfactant or mixtures of an ionic surfactant and a nonionic surfactant; the latex is a latex emulsion; and wherein the (ii) colorant dispersion is blended with the latex emulsion comprised of resin, a nonionic surfactant or a hydrolyzable nonionic and an ionic surfactant, and optionally adding a wax dispersion comprised of submicron particles in the size range of about 0.1 to about 0.4 micron dispersed in an ionic surfactant of the same charge polarity of that of the ionic surfactant in the colorant dispersion or latex emulsion;

(iii) adding to the resulting blend containing the latex and colorant a polyamine coagulant to thereby initiate aggregation of the resin latex and colorant particles;

(iv) heating the resulting mixture below about, or about equal to the glass transition temperature (Tg) of the latex resin to form toner sized aggregates;

(v) adding a latex comprised of submicron resin particles suspended in an aqueous phase to the formed toner aggregates;

(vi) adjusting with a base the pH of the resulting toner aggregate mixture to about 5 to about 9;

(vii) heating the resulting aggregate suspension of (vi) above about, or about equal to the Tg of the latex resin;

(viii) retaining the mixture (vii) temperature in the range of from about 70° C. to about 95° C. to enable the fusion or coalescence of the toner aggregates;

(ix) optionally washing the resulting toner slurry; and (x) isolating the toner wherein the toner particle size is about 2 about 25 microns; a process wherein there is added to (ii) a wax dispersion comprised of submicron particles in the size diameter range of about 0.1 to about 0.4 micron dispersed in an anionic surfactant of the same charge polarity of that of the ionic surfactant in the latex emulsion; a process wherein the oxidizing agent functions primarily to remove the coagulant, such as a polyamine salt; a process wherein the oxidizing agent is bleach, oxone, sodium perlodate, sodium bromate or ammonium persulfate; a process wherein the polyamine salt is of a negative polarity or of a positive polarity, and which salt is of an opposite polarity of said ionic surfactant; a process wherein the polyamine salt is dialkylene triamine acid; a process wherein the polyamine salt is diethylene triamine hydrochloric acid; a process wherein the (viii), (x), and (xi) are accomplished, and (viii) is optionally effected for a period of from about 3 to about 8 hours, and wherein the polyamine salt is formed by the reaction on organic aliphatic or aromatic amine with an acid; and a process wherein (viii), (x) and (xi) are accomplished and the polyamine salt is an aliphatic amine of diethylene triamine, spermidine, or 3,3'-diamino-N-methyldipropylamine, or said polyamine salt is an organic amine of N,N',N"-tribenzyltris-(2-aminoethyl) amine or N'-benzyl-N,N-dimethylethylene diamine.

Disclosed is a process wherein the inorganic oxidative reagent is selected from a group of sodium hypochlorite, sodium periodate, ammonium persulfate, potassium persulfate and wherein a preferred reagant is sodium hypochlorite and is present in the amount of 1 to about 20 percent by weight of toner comprising resin, colorant, and optional wax; a process wherein the organic oxidative reagent is selected from a group of N-chlorosuccinamide, N-bromosuccinamide, peracetic acid, perbenzoic acid present in the amount of 1 to about 20 percent by weight of toner comprising resin, colorant, and optional wax, with the total of all toner components being 100 percent; a process wherein the use of oxidative reagents prevents the formation of positive ions, such as NH3+ or CH2+ ions, during (ix) at a pH lower than about 3 wherein no further or minimal aggregation or particle size growth is observed; a process wherein the polyamine salt coagulant is present in the amount of about 0.075 to about 5 percent by weight of toner comprising resin, and colorant; a process wherein there is added to the formed toner aggregates a second latex comprised of submicron resin particles suspended in an aqueous phase containing an ionic surfactant, and wherein the second latex is selected in an amount of about 10 to about 45 percent by weight of the initial latex to form a shell on the formed toner aggregates; a process wherein the aggregation temperature is from about 40° C. to about 60° C. and the coalescence temperature is from about 75° C. to about 97° C.; a process for the preparation of toner comprising (i) generating a colorant dispersion of a colorant, water, and an ionic surfactant, and a latex emulsion comprised of resin, water, and an ionic surfactant, and wherein the (ii) colorant dispersion is blended with the latex emulsion;

(iii) adding to the resulting blend containing the latex and colorant a coagulant of a polyamine salt with an opposite polarity to that of the surfactant latex to thereby initiate flocculation of the resin latex and colorant;

(iv) heating the resulting mixture below about the glass transition temperature (Tg) of the latex resin to form toner sized aggregates;

(v) adding a second latex comprised of submicron resin particles suspended in an aqueous phase to the formed toner aggregates of (iv) resulting in a shell wherein the shell is, for example, of from about 0.1 to about 2 microns in thickness and the shell coating is contained on about 100 percent on the aggregates;

(vi) adding an oxidative reagent, followed by adjusting with a base the pH of the resulting toner aggregate mixture from a pH which is in the initial range of about 1.9 to about 3 to a pH range of about 5 to about 9;

(vii) heating the resulting aggregate suspension of (vi) above the Tg of the latex resin; and (viii) changing the pH of the above (vi) mixture by the addition of a metal salt to arrive at a pH in the range of about 2.8 to about 5; a process capable of generating acceptable stable toner triboelectrical toner values with minimum toner washings; a process for the preparation of toner compositions, with a volume average diameter of from about 1 to about 25 microns, and more specifically, from about 2 to about 12 microns, and a particle size distribution of about 1.10 to about 1.28, and more specifically, from about 1.15 to about 1.25, each as measured by a Coulter Counter without the need to resort to conventional classifications to narrow the toner particle size distribution; a process for the preparation of pigmented toner particles wherein the latex selected can be prepared by batch polymerization or semi-batch polymerization processes containing submicron resin particles suspended in an aqueous phase of surfactants aggregated with submicron pigment particles and a polyamine salt coagulant comprised of dithylenetriamine and an acid, such as hydrochloride acid; a process for providing toner compositions with low fusing temperatures of from about 140° C. to about 185° C., and which toner compositions exhibit excellent blocking characteristics at and above about 48° C., excellent print quality and high resolution color prints; providing toner compositions which provide high image projection efficiency, such as for example over 75 percent as measured by the Match Scan II spectrophotometer available from Milton-Roy; a process for the preparation of toner comprising mixing a colorant, a latex, optionally a wax and a polyamine salt of hydrochloric acid as a coagulant, and which coagulant assists in permitting aggregation and coalescence of the colorant, the resin latex, and when present the wax; a process for preparing a chemical toner comprising (i) generating a latex emulsion of resin, water, an ionic surfactant, a colorant dispersion of a colorant, water, an ionic surfactant, or a nonionic surfactant, and wherein the (ii) the latex emulsion is blended with the colorant dispersion followed by adding a wax dispersion comprised of submicron particles in the size diameter range of about 0.1 to about 0.5 micron dispersed in an anionic surfactant of the same charge polarity of that of the ionic surfactant in the latex emulsion;

(iii) adding to the resulting blend containing the latex and colorant, a coagulant of a polyamine salt of hydrochloric acid or optionally a polyamine salt of sulfuric acid wherein the salt formed is of an opposite charge polarity to that of the surfactant latex to thereby initiate flocculation of the resin latex and colorant particles;

(iv) heating the resulting mixture below or about equal to the glass transition temperature (Tg) of the latex resin to form toner sized aggregates of resin and colorant;

(v) optionally adding a second latex comprised of submicron resin particles suspended in an aqueous phase to the formed toner aggregates of (iv) resulting in a shell wherein the shell is, for example, of from about 0.1 to about 1 micron in thickness;

(vi) adding an organic or an inorganic oxidizing agent, such as N-chlorosuccinamide or sodium hypochlorite, to the aggregates of (v) followed by adjusting with a base the resulting toner aggregate mixture from a pH which is in the range of about 1.9 to about 3 to a pH range of about 5 to about 9, or to about 7 to about 8, to primarily stabilize the aggregates;

(vii) heating the resulting aggregate suspension of (vi) above the Tg of the latex resin;

(viii) retaining the mixture (vii) temperature in the range of from about 70° C. to about 95° C. for a suitable period of, for example, about 3 to about 10 hours to initiate the fusion or coalescence of the toner aggregates;

(ix) changing the pH of the above (viii) mixture with an acid to arrive at a pH in the range of about 1.5 to about 3.5 and more specifically, about 1.7 to about 3 to accelerate the fusion or the coalescence resulting in toner particles comprised of resin, colorant, and wax, wherein the toner particle size is about 2 about 25 microns;

(x) washing the resulting toner slurry; and (xi) isolating the toner, followed by drying the toner particles; a process wherein the oxidative reagents can be an inorganic component, such as sodium hypochlorite, sodium periodate, ammonium persulfate, potassium persulfate, or an organic oxidant, such as peracids, for example N-chlorosuccinamide; a process wherein the polyamine salt is selected in an amount of from about 0.05 to about 10 percent, and more specifically, in an amount of about 0.1 to about 5 by weight of toner solids of latex resin, colorant, optional wax and the polyamine salt, and wherein the latex resin, colorant, and wax amount totals about 100 percent; a process wherein there is added an oxidizing agent, such as sodium hypochlorite or bleach, to the formed aggregates; a process wherein the oxidizing agent is added in an amount of about 1 to about 20 weight percent, and more specifically, from about 1.5 to about 10 weight percent of the toner, and wherein, more specifically, the concentration of the oxidizing agent is in the range of about 5 weight percent by weight of water; a process wherein the base is selected from the group consisting of sodium hydroxide, potassium hydroxide, and ammonium hydroxide, and wherein the base is selected in an amount of about 0.5 to about 20 percent or from about 1 to about 10 percent by weight of water; a process wherein there is added to the formed toner aggregates a second latex comprised of submicron resin particles suspended in an aqueous phase containing an ionic surfactant, and wherein the second latex is selected in an amount of, for example, about 10 to about 40 percent by weight of the initial latex to form a shell on the aggregates; a process wherein the added latex contains the same resin as the initial latex, or wherein the added latex contains a dissimilar or different resin than that of the initial resin latex; a process wherein the temperature at which the aggregation is accomplished controls the size of the aggregates, and wherein the final toner size is from about 3 to about 15 microns in volume average diameter; a process wherein the aggregation (iv) temperature is from about 45° C. to about 55° C., and wherein the coalescence or fusion temperature of (vii) and (viii) is from about 85° C. to about 95° C.; a process wherein the coagulant is added during or prior to aggregation of the latex resin and colorant, and which coagulant enables or initiates the aggregation; a process wherein the colorant is carbon black, cyan, yellow, blue, green, brown, magenta, or mixtures thereof; a process wherein the toner isolated is from about 2 to about 20 microns in volume average diameter, and the particle size distribution (GSD) thereof is from about 1.15 to about 1.30; and wherein there is added to the surface of the formed toner additives, such as metal salts, metal salts of fatty acids, silicas, coated silicas, metal oxides, or mixtures thereof, each in an amount of from about 0.1 to about 5 weight percent of the obtained toner; a process wherein there is added to the formed toner aggregates a second latex (v) in the amount of about 10 to about 50 percent by weight of the initial latex or in an amount of about 15 to about 30 weight percent to form a shell on the first latex; a process wherein the added latex comprises the same resin composition and molecular properties as the initial latex step or a different composition and properties than that of the initial latex; a process wherein the aggregation is accomplished by heating at a temperature of below about the glass transition temperature of the polymer contained in the latex (i); a process wherein the coalescence is accomplished by heating at a temperature of above about the glass transition temperature of the polymer contained in the latex (i); a process wherein the aggregation temperature is from about 40° C. to about 62° C., and more specifically, is from about 45° C. to about 58° C.; a process wherein the coalescence temperature is from about 75° C. to about 95° C., and more specifically, about 85° C. to about 90° C.; a process wherein the amount of base selected is from about 1 to about 8 weight percent; a process wherein the amount of metal hydroxide selected is from about 5 to about 15 weight percent; a process wherein the latex contains submicron polymer or resin particles containing a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly (methylstyrene-butadiene), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly (methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly (styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process wherein there is selected a latex comprised of submicron resin particles in the size range of about 0.05 to about 0.5 micron or in the size range of about 0.07 to about 0.35 micron, suspended in an aqueous water phase containing an ionic surfactant, which surfactant is selected in an amount of about 0.5 to about 5 percent, or about 0.7 to about 2 percent by weight of solids, to which is added a colorant dispersion comprising submicron, for example less than, or equal to about 0.5 micron, colorant particles, anionic or a nonionic surfactant which is selected in the range amount of about 0.5 to about 10 percent, and more specifically, about 0.6 to about 5 percent by weight of solids, which when blended together result in a mixture with a pH in the range of about 2 to about 2.6 to which a polyamine salt of an acid, such as a polyamine salt of a hydrochloric acid, is added slowly over, for example, a period of about 2 to about 5 minutes, wherein the amount of polyamine salt is selected in the amount of about 0.0.1 to about 5 percent by weight of the final toner comprising latex solids, colorant and optional wax components; further aggregating by stirring and heating from about 5° C. to about 10° C. below the resin Tg, resulting in toner aggregates of a size of about 3 to about 15 microns, and more specifically, about 4 to about 8 microns with a narrow GSD in the range of, for example, about 1.14 to about 1.28, and more specifically, in the range of about 1.17 to about 1.25, followed by adding an oxidative reagent, such as sodium hypochlorite, and then adjusting the pH of the mixture from about 2 to about 2.6 to a pH of about 6 to about 9, and more specifically, to about 7 to about 8.5, and yet more specifically, to a pH of about 8 with the addition of a dilute base solution of 4 weight percent of sodium hydroxide to primarily stabilize the aggregates, further stirring and increasing the mixture temperature above the resin Tg, in the range of about 70° C. to about 95° C., and more specifically, in the range of about 85° C. to about 93° C. for a period of about 0.5 to about 1.5 hours, followed by changing the pH from about 8 to about 2 by the use of an acid, such as dilute nitric acid, wherein the concentration of acid is in the range of about 0.5 to about 10 weight percent, and more specifically, in the range of about 0.75 to about 5 weight percent, and heating the mixture for an additional about 0.5 to about 4 hours, and more specifically, from about 0.6 to about 3 hours, to fuse or coalesce the aggregates, and then washing and drying the toner; a process wherein the use of an oxidizing agent allows the pH of the mixture to be reduced to below a pH of 3 enabling rapid spheroidization of the toner particles wherein the spheroidization time is reduced by about 50 percent as compared to a process without the use of the oxidization reagents; a process for the preparation of toner compositions which comprise blending an aqueous colorant dispersion containing a pigment, such as carbon black, phthalocyanine, quinacridone, or more specifically, RHODAMINE B™ type, red, green, orange, brown, violet, yellow, fluorescent colorants and the like, with a latex emulsion derived from the emulsion polymerization of monomers selected, for example, from the group consisting of styrene, butadiene, acrylates, methacrylates, acrylonitrile, acrylic acid, methacrylic acid, itaconic or Beta Carboxy Ethyl Acrylate (βCEA) and the like, and which latex contains an ionic surfactant, such as sodium dodecylbenzene sulfonate, and a nonionic surfactant; and a process wherein the particle size of the toner provided by the processes of the present invention in embodiments can be controlled, for example, by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 14 percent by weight, an aggregate size of about 7 microns in volume average diameter can be obtained at an aggregation temperature of about 53° C.; the same latex will provide an aggregate size of about 5 microns at a temperature of about 48° C. under similar conditions.

Illustrative examples of resin, polymer or polymers selected for the process of the present invention and present in the latex (i) or added latex include known polymers, such as poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner compositions in various suitable amounts, such as from about 75 weight percent to about 98, or from about 80 to about 95 weight percent of the toner or of the solids, and the latex size suitable for the processes of the present invention can be, for example, from about 0.05 micron to about 0.5 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymer selected for the process of the present invention can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, the disclosure of which is totally incorporated herein by reference, can be selected for the processes of the present invention in embodiments thereof.

Examples of waxes include those as illustrated herein, such as those of the aforementioned copending applications, polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes selected possess, it is believed, a molecular weight $M_w$ of from about 1,000 to about 1,500, while the commercially available polypropylenes utilized for the toner compositions of the present invention are believed to have a molecular weight of from about 4,000 to about 5,000. Examples of functionalized waxes include, such as amines, amides, for example aqua SUPERSLIP 6550, SUPERSLIP 6530 available from Micro Powder Inc., fluorinated waxes, for example POLYFLUO 190, POLYFLUO 200, POLYFLUO 523XF, AQUA POLYFLUO 411, AQUA POLYSILK 19, POLYSILK 14 available from Micro Powder Inc., mixed fluorinated, amide waxes, for example MICROSPERSION 19 also available from Micro Powder Inc., imides, esters, quaternary amines, carboxylic acids or acrylic polymer emulsion, for example JONCRYL 74, 89, 130, 537, and 538, all available from SC Johnson Wax, chlorinated polypropylenes and polyethylenes available from Allied Chemical and Petrolite Corporation and SC Johnson wax.

Various known colorants, such as pigments, selected for the processes of the present invention and present in the toner in an effective amount of, for example, from about 1 to about 25 percent by weight of toner, and more specifically, in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, C Dispersed Yellow 33 2,5-dimethoxy-4-sulfonanilide phenylazo-4'-chloro-2,5-dimethoxy acetoacetanilide, Yellow 180 and Permanent Yellow FGL. Colored magnetites, such as mixtures of MAPICO BLACK™, and cyan components may also be selected as pigments for the processes of the present invention, wherein the pigment amount is, for example, about 3 to 15 weight percent of the toner. Dye examples include known suitable dyes, reference the Color Index, and a number of U.S. patents, inclusive of food dyes, and the like.

Colorants include pigment, dye, mixtures of pigment and dyes, mixtures of pigments, mixtures of dyes, and the like.

Examples of initiators for the latex preparation include water soluble initiators, such as ammonium and potassium persulfates, in suitable amounts, such as from about 0.1 to about 8 percent, and more specifically, from about 0.2 to about 5 percent (weight percent). Examples of organic soluble initiators include Vazo peroxides, such as VAZO 64, 2-methyl 2-2'-azobis propanenitrile, VAZO 88, 2-2'-azobis isobutyramide dehydrate in a suitable amount, such as in the range of from about 0.1 to about 8 percent. Examples of chain transfer agents include dodecanethiol, octanethiol, carbon tetrabromide and the like in various suitable amounts, such as in the range amount of from about 0.1 to about 10 percent, and more specifically, in the range of from about 0.2 to about 5 percent by weight of monomer.

Surfactants for the preparation of latexes and colorant dispersions can be ionic or nonionic surfactants, in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like. Examples of cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, selected in effective amounts of, for example, from about 0.01 percent to about 10 percent by weight. The molar ratio of the cationic surfactant used for flocculation to the anionic surfactant used in the latex preparation is, for example, in the range of from about 0.5 to about 4.

Examples of nonionic surfactants selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, can be selected.

The toner may also include known charge additives in effective suitable amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, coated silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Additive examples include zinc stearate and AEROSIL R972® available from Degussa. The coated silicas of copending applications U.S. Ser. No. 09/132,623 and U.S. Pat. No. 6,004,714, the disclosures of which are totally incorporated herein by reference, can also be selected in amounts, for example, of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos 4,265,990; 4,858,884; 4,584,253 and 4,563,408, the disclosures of which are totally incorporated herein by reference.

The following Examples and Comparative Examples are presented.

EXAMPLES

Latex Preparation-Semicontinuous Method (E/A 12-45)

A latex emulsion comprised of polymer particles generated from the emulsion polymerization of styrene, butyl acrylate and beta carboxyl ethyl acrylate (βCEA) was prepared as follows. A surfactant solution of 1.59 kilograms of DOWFAX 2A1 (anionic emulsifier) and 430 kilograms of deionized water was prepared by mixing for 10 minutes in a stainless steel holding tank. The holding tank was then purged with nitrogen for 5 minutes before transferring the mixture resulting into a reactor. The reactor was then continuously purged with nitrogen while being stirred at 100 RPM. The reactor was then heated up to 80° C. Separately, 6.8 kilograms of ammonium persulfate initiator were dissolved in 33.55 kilograms of deionized water and added.

Separately, a monomer emulsion was prepared in the following manner. 366 Kilograms of styrene, 86 kilograms of butyl acrylate, 14 kilograms of β-CEA, 6 kilograms of 1-dodecanethiol, 3 kilograms of dodecanediol diacrylate (ADOD), 8.05 kilograms of DOWFAX (anionic surfactant), and 216 kilograms of deionized water were mixed to form an emulsion. Five percent of the above emulsion was then slowly fed into the reactor containing the above aqueous surfactant phase at 80° C. to form "seeds" while being purged with nitrogen. The initiator solution was then slowly charged into the reactor and after 10 minutes the remainder of the emulsion was continuously fed into the reactor using metering pumps.

Once all the monomer emulsion was charged into the main reactor, the temperature was held at 80° C. for an additional 2 hours to complete the reaction. Full cooling was then accomplished and the reactor temperature was reduced to 35° C. The product was collected in a holding tank. After drying the latex, the resin molecular properties were $M_w$=60, 500, $M_n$=11,800, and the onset Tg was 58.6° C. The latex was comprised of 40 percent resin, 58.5 percent water and 1.5 percent anionic surfactant.

TONER PREPARATION EXAMPLES

Example I

Preparation of Cvan Toner:

236.5 Grams of the above prepared latex emulsion (latex A) and 150 grams of an aqueous cyan pigment dispersion containing 49.8 grams of blue pigment PB 15.3 having a solids loading of 35.5 percent were simultaneously added to 505 milliliters of water at room temperature, about 25° C., while being mixed at a shear speed of 5,000 rpm by means of a polytron (mixture A). A coagulant containing 17.5 grams of diethylene triamine in 82.5 grams of water was prepared and acidified to a pH of 2.5 with hydrochloric acid resulting in an acidified aqueous solution of diethylenetriamine hydrochloric acid salt (solution B).

To the above mixture A were added 16 grams of the above aqueous amine salt solution containing 1.6 grams of solution A and 14.4 grams of water, over a period of 2 minutes, and blending at speeds of 5,000 rpm for a period of 2 minutes. The resulting mixture which had a pH of 2.7 was then transferred to a 2 liter reaction vessel and heated at a temperature of 58° C. for 120 minutes resulting in aggregates of a size of 6.5 microns and a GSD of 1.20. To the resulting toner aggregates were added 108.2 grams of the above prepared latex (latex A) followed by stirring for an additional 30 minutes while being heated at 60° C. The particle size was found to be 7 and the GSD was 1.19. 50 Millimeters of 5 percent concentration, commercial bleach (sodium hypochlorite) were added to the resulting mixture followed by adjusting the pH from about 2.7 to about 7.9 with an aqueous base solution of 4 percent sodium hydroxide followed by stirring for an additional 15 minutes. Subsequently, the resulting mixture was heated to 90° C. and retained there for a period of 1 hour. The pH of the resultant mixture was then lowered from about 7.6 to about 1.8 with 5 percent nitric acid. After 7 hours (total) at a temperature of 95° C. the particles generated were in the form of spheres and had a size of 7.2 microns with a GSD of 1.18 as observed under an optical microscope. The reactor was then cooled down to room temperature and the toner particles were isolated and washed 4 times, where the first wash was conducted at pH of 11, followed by 2 washes with deionized water, and the last wash at a pH of 2. The toner particles were then dried on a freeze dryer. The resulting toner was comprised of 89 percent resin of latex A and 11 percent of the above cyan PB 15.3 pigment.

Example II

Preparation of Yellow Toner:

236.5 Grams of the above prepared latex emulsion (latex A) and 150 grams of an aqueous pigment dispersion containing 119.2 grams of yellow pigment PY 74 having a solids loading of 14.8 percent were simultaneously added to 405 milliliters of water at room temperature while being mixed at a shear speed of 5,000 rpm by means of a polytron (mixture A). A coagulant containing 17.5 grams of diethylenetriamine in 82.5 grams of water was prepared and acidified to a pH of 2.5 with hydrochloric acid resulting in an acidified aqueous solution of diethylenetriame hydrochloric acid salt (solution B).

To the above mixture A were added 16.5 grams of an aqueous amine salt solution B containing 1.8 grams of solution A and 14.7 grams of water, over a period of 2 minutes, and blended at speeds of 5,000 rpm for a period of 2 minutes. The resulting mixture, which had a pH of 2.7, was then transferred to a 2 liter reaction vessel and heated at a temperature of 58° C. for 120 minutes resulting in aggregates of a size of 6.5 microns and a GSD of 1.20. To the resulting toner aggregate were added 108.2 grams of the above prepared latex (latex A) followed by stirring for an additional 30 minutes while being heated at 60° C. The particle size was found to be 7 with a GSD of 1.19. 50 Milliliters of 5 percent concentration, commercial bleach (sodium hypochlorite) were added to the resulting mixture followed by adjusting the pH from about 2.7 to about 7.9 with an aqueous base solution of 4 percent sodium hydroxide and followed by stirring for an additional 15 minutes. Subsequently, the resulting mixture was heated to 90° C. and retained there for a period of 1 hour. The pH of the resultant mixture was then lowered from about 7.6 to about 1.8 with 5 percent nitric acid. After 7 hours (total) at a temperature of 95° C., the particles were in the form of spheres and had a size of 7.2 microns with a GSD of 1.18 as observed under an optical microscope. The reactor was then cooled down to room temperature and the particles were washed 4 times, where the first wash was conducted at pH of 11, followed by 2 washes with deionized water, and the last wash carried out at a pH of 2. The particles were then dried on a freeze dryer. The resulting toner was comprised of 89 percent resin of latex A and 11 percent of the above Yellow 74 pigment.

Example III

Preparation of Magenta Toner:

236.5 Grams of the above prepared latex emulsion (latex A) and 150 grams of an aqueous pigment dispersion containing 34.4 grams of red pigment PR 81.3 having a solids loading of 36.5 percent were simultaneously added to 520 milliliters of water at room temperature while being mixed at a shear speed of 5,000 rpm by means of a polytron (mixture A). A coagulant containing 17.5 grams of diethylenetriamine in 82.5 grams of water was prepared and acidified to a pH of 2.5 with hydrochloric acid resulting in an acidified aqueous solution of diethylenetriamine hydrochloric acid salt (solution B).

To the above mixture A were added 16.5 grams of an aqueous amine salt solution B containing 1.8 grams of solution A and 14.7 grams of water, over a period of 2 minutes, and blended at speed of 5,000 rpm for a period of 2 minutes. The resulting mixture, which had a pH of 2.7, was then transferred to a 2 liter reaction vessel and heated at a temperature of 58° C. for 120 minutes hours resulting in aggregates of a size of 6.3 microns and a GSD of 1.20. To the formed toner aggregate were added 108.2 grams of the above prepared latex (latex A) followed by stirring for an additional 30 minutes while being heated at 60° C. The particle size was found to be 6.7 and a GSD of 1.19. 50 Milliliters of 5 percent concentration, commercial bleach (sodium hypochlorite) were added to the resulting mixture followed by adjusting the pH from about 2.7 to about 7.9 with an aqueous base solution of 4 percent sodium hydroxide followed by stirring for an additional 15 minutes. Subsequently, the resulting mixture was heated to 90° C. and retained there for a period of 1 hour. The pH of the resultant mixture was then lowered from about 7.6 to about 1.9 with 5 percent nitric acid. After 7 hours (total) at a temperature of 95° C., the particles were in the form of spheres or spherical in shape, and had a size of 6.8 microns with a GSD of 1.19 as observed under the optical microscope. The reactor was then cooled down to room temperature and the particle were washed 4 times, where the first wash was conducted at pH of 11, followed by 2 washes with deionized water, and the last wash carried out at a pH of 2. The particles were then dried on a freeze dryer. The toner resulting was comprised of 81.7 percent resin of latex A and 8.3 percent of the above Red 81.3 pigment.

Other embodiments and modifications of the present invention may occur to those skilled in the art subsequent to a review of the information presented herein; these embodiments modifications, and equivalents thereof, are also included within the scope of this invention.

What is claimed is:

1. A process for the preparation of toner comprising (i) providing or generating a latex emulsion of resin, water, and an ionic surfactant, and providing or generating a colorant dispersion containing a colorant, water, an ionic surfactant, or a nonionic surfactant, and wherein (ii) the latex emulsion is blended with the colorant dispersion;

(iii) adding to the resulting blend containing the latex and colorant a polyamine salt coagulant;

(iv) heating the resulting mixture below about the glass transition temperature (Tg) of the latex resin;

(v) optionally adding a second latex comprised of resin particles suspended in an aqueous phase;

(vi) adding an oxidative or oxidizing agent or component to (v) followed by changing the pH with a base from an initial pH of about 1.9 to about 3 to a pH of about 5 to about 9;

(vii) heating (vi) above about the Tg of the latex resin;

(viii) optionally retaining the mixture (vii) at a temperature of from about 70° C. to about 95° C.;

(ix) changing the pH of the mixture (viii) by the addition of an acid to arrive at a pH in the range of about 1.5 to about 3.5;

(x) optionally washing the resulting toner slurry; and (xi) optionally isolating the toner.

2. A process in accordance with claim 1 wherein said polyamine salt is selected in an amount of from about 0.05 to about 5 percent by weight of toner.

3. A process in accordance with claim 1 wherein said oxidative agent is selected from the group consisting of an inorganic component of sodium hypochlorite, sodium periodate, ammonium persulfate, and potassium persulfate.

4. A process in accordance with claim 1 wherein the polyamine salt coagulant is subjected to an oxidative reaction resulting in neutralization and the formation of cationic ions upon reducing the pH to a value of from about 1.5 to about 3.

5. A process in accordance with claim 1 (vi) wherein the oxidative agent functions as a toner aggregate stabilizer and allows the pH reduction in (ix) to accelerate the fusion (vii) of toner aggregates formed in (vi).

6. A process in accordance with claim 1 wherein the oxidative agent prevents or minimizes the formation of positive ions of aluminum ions ($Al^{3+}$) during (ix), and wherein no further or minimal toner particle size growth results.

7. A process in accordance with claim 1 (vi) wherein said base is a metal hydroxide selected from the group consisting of sodium hydroxide, potassium hydroxide, and ammonium hydroxide.

8. A process in accordance with claim 1 wherein the oxidative or oxidizing agent is selected in an amount of about 0.1 to about 5 percent by weight of toner solids.

9. A process in accordance with claim 1 wherein there is added during or subsequent to (iv) said second latex, and which latex is comprised of submicron resin particles suspended in an aqueous phase containing an ionic surfactant, and wherein said second latex is optionally selected in an amount of about 10 to about 40 percent by weight of the initial latex, and wherein there is formed a shell or coating on the product of (iv).

10. A process in accordance with claim 1 wherein said second latex (v) is added and enables formation of a coating on the resulting toner aggregates of (iv), and wherein the thickness of the formed coating is from about 0.1 to about 1 micron.

11. A process in accordance with claim 10 wherein the added latex contains the same resin as the initial latex of (i), or wherein said added latex contains a dissimilar resin than that of the initial latex resin (i).

12. A process in accordance with claim 1 wherein (iv) is accomplished by heating at a temperature below about the glass transition temperature of the resin or polymer contained in the latex (i) and (vii) is accomplished by heating at a temperature of above about the glass transition temperature of the polymer contained in the latex (i) to enable fusion or coalescence of colorant and latex resin (i).

13. A process in accordance with claim 12 wherein said temperature (iv) is from about 40° C. to about 60° C., and said temperature (vii) is from about 75° C. to about 97° C.

14. A process in accordance with claim 1 wherein the pH of the mixture resulting in (vi) is increased from an initial about 2 to about 2.6 to about 5 to about 8, and wherein said base functions primarily as a stabilizer for the product of (iv).

15. A process in accordance with claim 1 subsequent to (iv) toner aggregates are formed, and wherein the temperature at which the aggregation is accomplished controls the size of the aggregates, and wherein the toner isolated is from about 2 to about 15 microns in volume average diameter, and wherein said heating (viii) is accomplished.

16. A process in accordance with claim 1 wherein the colorant is a pigment, and wherein said pigment is in the form of dispersion, and which dispersion contains an ionic surfactant.

17. A process in accordance with claim 1 wherein the latex (i) contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly (styrene-butyl acrylate-acrylononitrile-acrylic acid).

18. A process in accordance with claim 1 wherein the colorant is carbon black, cyan, yellow, magenta, or mixtures thereof, and the toner isolated is from about 2 to about 15 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner.

19. A process in accordance with claim 1 wherein said polyamine salt is an aliphatic polyamine acid.

20. A process in accordance with claim 19 wherein said acid is hydrochloric acid, sulfuric acid, nitric acid or phosphoric acid.

21. A process in accordance with claim 1 wherein said polyamine is an aromatic polyamine acid salt.

22. A process for the preparation of toner comprising mixing a colorant, a latex, and a polyamine followed by aggregation and coalescence, and wherein said process is accomplished in the presence of an oxidizing agent.

23. A process in accordance with claim 22 wherein said colorant is a colorant dispersion comprised of (i) a colorant, water, an ionic surfactant, a nonionic surfactant or mixtures of an ionic surfactant and a nonionic surfactant; said latex is a latex emulsion; and wherein said (ii) colorant dispersion is blended with said latex emulsion comprised of resin, a nonionic surfactant or a hydrolyzable nonionic and an ionic surfactant, and optionally adding a wax dispersion comprised of submicron particles in the size range of about 0.1 to about 0.4 micron dispersed in an ionic surfactant of the same charge polarity to that of the ionic surfactant in said colorant dispersion or latex emulsion;

(iii) adding to the resulting blend containing the latex and colorant said polyamine to thereby initiate aggregation of the resin latex and colorant particles;

(iv) heating the resulting mixture below about, or about equal to the glass transition temperature (Tg) of the latex resin to form toner sized aggregates;

(v) adding a latex comprised of resin particles suspended in an aqueous phase to the formed toner aggregates;

(vi) adjusting with a base the pH of the resulting toner aggregate mixture to about 5 to about 9;

(vii) heating the resulting aggregate suspension of (vi) above about, or about equal to the Tg of the latex resin;

(viii) retaining the mixture (vii) temperature in the range of from about 70° C. to about 95° C. to enable the fusion or coalescence of the toner aggregates, wherein the toner particle size is about 2 about 25 microns;

(ix) washing the resulting toner slurry; and (x) isolating the toner.

24. A process in accordance with claim 1 wherein there is added to (ii) a wax dispersion optionally comprised of submicron particles in the size diameter range of about 0.1 to about 0.5 micron dispersed in an anionic surfactant of the same charge polarity as that of the ionic surfactant in the latex emulsion.

25. A process in accordance with claim 1 wherein said oxidizing agent functions primarily to remove said polyamine salt.

26. A process in accordance with claim 25 wherein said oxidizing agent is bleach, oxone, sodium perlodate, sodium bromate or ammonium persulfate.

27. A process in accordance with claim 1 wherein said polyamine salt is of a negative polarity or of a positive polarity, and which salt is of an opposite polarity of said ionic surfactant.

28. A process in accordance with claim 1 wherein said polyamine salt is dialkylene triamine acid.

29. A process in accordance with claim 1 wherein said polyamine salt is diethylene triamine hydrochloric acid.

30. A process in accordance with claim 1 wherein said (viii), said (x), and said (xi) are accomplished, and said (viii) is optionally effected for a period of from about 3 to about 8 hours, and wherein said polyamine salt is formed by the reaction on organic aliphatic amine or aromatic amine with an acid.

31. A process in accordance with claim 1 wherein (viii), (x) and (xi) are accomplished and said polyamine salt is an aliphatic amine of diethylene triamine, spermidine, or 3,3'-diamino-N-methyldipropylamine, or said polyamine salt is an organic amine of N,N',N''-tribenzyltris-(2-aminoethyl) amine or N'-benzyl-N,N-dimethylethylene diamine.

32. A process for the preparation of toner comprising (i) providing or generating a latex emulsion of resin, water, and an ionic surfactant, and providing or generating a colorant dispersion containing a colorant, water, an ionic surfactant, or a nonionic surfactant, and wherein (ii) the latex emulsion is blended with the colorant dispersion;

(iii) adding to the resulting blend containing the latex and colorant a polyamine salt coagulant;

(iv) heating the resulting mixture below about the glass transition temperature (Tg) of the latex resin;

(v) optionally adding a second latex comprised of resin particles suspended in an aqueous phase;

(vi) adding an oxidative or oxidizing agent or component to (v) followed by changing the pH with a base from an initial pH of about 1.9 to about 3 to a pH of about 5 to about 9;

(vii) heating (vi) above about the Tg of the latex resin;

(viii) optionally retaining the mixture (vii) at a temperature of from about 70° C. to about 95° C.;

(ix) changing the pH of the mixture (viii) by the addition of an acid to arrive at a pH in the range of about 1.5 to about 3.5;

(x) optionally washing the resulting toner slurry; and (xi) optionally isolating the toner; and wherein said oxidizing agent is selected from the group consisting of an inorganic component of sodium hypochlorite, sodium periodate, ammonium persulfate, and potassium persulfate.

33. A process in accordance with claim 32 wherein the polyamine salt coagulant is subjected to an oxidative reaction resulting in neutralization and the formation of cationic ions upon reducing the pH to a value of from about 1.5 to about 3.

34. A process in accordance with claim 32 wherein the oxidative agent functions as a toner aggregate stabilizer and allows the pH reduction in (ix) to accelerate the fusion (vii) of toner aggregates formed in (vi).

35. A process in accordance with claim 32 wherein the oxidative agent prevents or minimizes the formation of positive ions of aluminum ions ($Al^{3+}$) during (ix), and wherein no further or minimal toner particle size growth results.

* * * * *